US010136480B2

(12) United States Patent
Boonen et al.

(10) Patent No.: US 10,136,480 B2
(45) Date of Patent: Nov. 20, 2018

(54) CIRCUIT ARRANGEMENT

(71) Applicant: Philips Lighting Holding B.V., Eindhoven (NL)

(72) Inventors: Paul Theodorus Jacobus Boonen, Tegelen (NL); Dmytro Viktorovych Malyna, Eindhoven (NL); Ralph Kurt, Eindhoven (NL); Harald Josef Günther Radermacher, Aachen (DE); Bertrand Johan Edward Hontele, Breda (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 169 days.

(21) Appl. No.: 14/385,275

(22) PCT Filed: Mar. 15, 2013

(86) PCT No.: PCT/IB2013/052066
§ 371 (c)(1),
(2) Date: Sep. 15, 2014

(87) PCT Pub. No.: WO2013/136301
PCT Pub. Date: Sep. 19, 2013

(65) Prior Publication Data

US 2015/0048757 A1 Feb. 19, 2015

Related U.S. Application Data

(60) Provisional application No. 61/699,353, filed on Sep. 11, 2012.

(30) Foreign Application Priority Data

Mar. 16, 2012 (EP) ..... 12159984

(51) Int. Cl.
*H05B 33/08* (2006.01)
*H05B 37/02* (2006.01)

(52) U.S. Cl.
CPC ..... *H05B 33/08* (2013.01); *H05B 33/083* (2013.01); *H05B 33/0815* (2013.01); *H05B 33/0845* (2013.01); *H05B 37/0209* (2013.01)

(58) Field of Classification Search
CPC ..... H05B 39/02; H05B 33/08; H05B 33/083; H05B 37/0209
See application file for complete search history.

(56) References Cited

U.S. PATENT DOCUMENTS

2008/0224636 A1 9/2008 Melanson
2009/0195168 A1 8/2009 Greenfeld
(Continued)

FOREIGN PATENT DOCUMENTS

JP 2012023001 A 2/2012
RU 2007142404 A 5/2009
(Continued)

*Primary Examiner* — Thai Pham
(74) *Attorney, Agent, or Firm* — Akarsh P. Belagodu

(57) ABSTRACT

A circuit arrangement (1), a detection circuit (50, 70) and an LED driver circuit (100, 110) is disclosed for operating at least one lighting unit, such as an LED unit, with a phase-cut operating voltage. The circuit arrangement (1) comprising at least an input (6) for receiving a phase-cut operating voltage from said power supply and/or an output (7) for connection to said at least one lighting unit and a pulse injection circuit, configured to determine a phase-cut operation of said power supply and to draw a current pulse from said power supply within a delay time between 200-700 μs after said phase-cut operation to provide a stable operation of said LED unit with the phase-cut power supply. The detection circuit (50,70) comprises at least an input (6) for receiving a phase-cut operating voltage from said power supply and a lamp compatibility detector (52, 72), configured to determine the
(Continued)

presence of a parallel lamp (57), connected in parallel with the detection circuit (50, 70) to said phase-cut power supply during operation and to provide a compatibility signal to a LED driver circuit (100, 110) corresponding to the determination of said parallel lamp (57), so that said driver circuit (100, 110) is set between a normal operating mode and a compatibility mode in dependence of the presence of said parallel lamp (57).

18 Claims, 10 Drawing Sheets

(56) References Cited

U.S. PATENT DOCUMENTS

| | | | | |
|---|---|---|---|---|
| 2010/0225251 | A1* | 9/2010 | Maruyama | H05B 33/0815 315/307 |
| 2011/0234115 | A1* | 9/2011 | Shimizu | H05B 33/0815 315/287 |
| 2012/0025729 | A1* | 2/2012 | Melanson | H05B 33/0815 315/224 |
| 2013/0221871 | A1* | 8/2013 | King | H05B 37/02 315/254 |

FOREIGN PATENT DOCUMENTS

| | | | |
|---|---|---|---|
| WO | 2011045371 | A1 | 4/2011 |
| WO | 2012007798 | A2 | 1/2012 |
| WO | 2012016197 | A1 | 2/2012 |

* cited by examiner

CIRCUIT ARRANGEMENT

CROSS-REFERENCE TO PRIOR APPLICATIONS

This application is the U.S. National Phase application under 35 U.S.C. § 371 of International Application No. PCT/IB13/052066, filed on Mar. 15, 2013, which claims the benefit of U.S. Provisional Patent Application No. 61/699,353, filed on Sep. 11, 2012 and European Patent Application No. 12159984.9 filed on Mar. 16, 2012. These applications are hereby incorporated by reference herein.

TECHNICAL FIELD

The present invention relates to the field of lighting and in particular to a circuit arrangement for operating a lighting unit with a phase-cut power supply, an LED lamp, a lighting system and a method of operating a lighting unit.

BACKGROUND ART

Today, LED-based lighting units are being used for many applications. The low power consumption and long lifetime of LEDs make them a very useful alternative to conventional light sources like incandescent lamps or light tubes. Hence, not only new-designed lighting equipment often utilizes LEDs, but in many markets LED products are being used to replace other light-sources like incandescent or halogen light sources, for instance. These so-called retrofit products have to be compatible with existing lighting/power supply systems.

In many lighting system topologies, dimmed light is needed. In the latter case, a phase-cut power supply/dimmer typically is placed between the lamp and mains. Here, the time evolution of the resulting voltage is a phase-cut sine wave (created by the dimmer).

Two types of phase-cut dimmers can be applied: trailing-edge dimmers and leading-edge dimmers. In both types of dimmers, a part of sinusoidal mains voltage is cut out either from the front part (leading-edge dimmer) or from the end part (trailing-edge dimmer) of the sine half-cycle to reduce the power flowing to the lamp load. Depending on the desired degree of dimming, the timing of the phase-cut edge may be adjusted so that a smaller or larger part of the mains voltage is cut out.

Trailing-edge dimmers are usually MOSFET-based and comprise an internal supply circuit which powers the timing and zero-crossing detection circuit. Leading-edge dimmers typically are TRIAC-based or based on two anti-parallel connected thyristors, where the load typically needs to be high enough to maintain the current in the TRIAC above the holding current.

While state-of-art dimmers are designed for and work well with conventional lighting means, such as incandescent and halogen lamps, a problem arises with the fact that LED lamps only consume approximately ⅓ of the power of these conventional lamps to generate the similar light flux. The largely reduced power, although beneficial to conserving energy, results in different problems in the different types of dimmers, such as visible flicker of the output light, in particular when operating multiple LED lamps connected to a single dimmer. In addition in a leading-edge dimmer, the under-load may pull the current in the TRIAC below the holding current. This causes the TRIAC to be set to a non-conductive or "disconnected" state, also referred to as "early disconnect".

The object of the present invention therefore is to provide a circuit arrangement for enhancing the operation of a LED lamp when connected with a phase-cut power supply and in particular when multiple lamps are connected to the same phase-cut power supply, so that a versatile use of the LED lamp is possible independent of the configuration of the lighting system.

DISCLOSURE OF INVENTION

According to the present invention, the object is solved by a circuit arrangement, a detection circuit and a LED driver circuit according to the independent claims. The dependent claims relate to preferred embodiments of the invention.

The basic idea of the present invention is that in particular in a configuration where multiple lamps are connected in parallel to a phase-cut power supply, i.e. comprising a phase-cut dimmer, the stability of the operation can be increased when drawing a current pulse from said power supply within a delay time between 200-700 μs after a phase-cut operation. Accordingly, in particular visible flicker of the output light can be substantially reduced.

The basic idea is based on the recognition of the present inventors that certain types of currently available LED lamps, in the following referred to as "first type of lamps" typically employ the principle of energy intake during a narrow conduction interval. The negative dI/dt that is created by the lamps with the narrow conduction interval induces an oscillation in the LC circuitry of the connected phase-cut dimmer and/or in the EMI filters of the lamps. On its turn this oscillation may cause "early disconnect" of a TRIAC when a phase-cut dimmer is used to provide operating power to the lamps. In the context of dimmers and in particular leading edge (LE) type of dimmers, the term "early" or "unintentional" disconnect refers to a switching device of said LE dimmer, e.g. a TRIAC, being set to the non-conductive state at an undesired point in time, i.e. before the zero-crossing of an alternating input voltage.

When applying the above current pulse, the oscillation is reduced so that the dimmer remains in the connected state and operates as intended. Beside the above mentioned reduced visible flicker, the present invention is particularly advantageous in a "mixed-load" configuration, i.e. in an arrangement where lamps with the narrow conduction interval are combined with lamps that employ the principle of energy intake during a wide conduction interval, in the following referred to as "improved power factor lamp" or "second type of lamp", e.g. connected in parallel to said first type of lamp. Lamps of the second type typically need operating power during the entire wide conduction interval to operate correctly. Here, the early interruption of energy delivery to the lamp with (intended) wide conduction interval may cause one of the following failures, resulting in an unacceptable light output and/or optical flicker: "early disconnect" of dimmer (especially random or not identical for all lamps and/or at each half cycle), fluctuations in floating (operating) voltage, jitter of edge position, failure of zero-crossing detection mechanism and disappearance of floating (operating) voltage at the lamps.

In the present context, the terms "narrow conduction interval" and "wide conduction interval" relate to a percentage of the time, in which the respective lamp draws sufficient current (above the hold current of the phase-cut power-supply/dimmer) to keep the dimmer in conduction compared to the nominal ON-time of a dimmer. The ON-time for a leading edge (LE) type of dimmer corresponds to the time between phase cut edge initiated by the dimmer and next zero-crossing of an alternating phase-cut operating (mains) voltage. A lamp of first type having a narrow conduction interval will typically show a disconnect phase of the dimmer, i.e. the TRIAC of the dimmer switches off before the next zero-crossing. Said disconnect phase of said first type of lamps typically is more than 0.5 ms, preferably 1 ms and most preferred 1.5 ms per half-cycle of the alternating operating voltage, which certainly may depend on the dim level. A lamp of first type (narrow conduction interval) is characterized by a percentage of less than 95%, preferably less than 80% and most preferred less than 50% of the ON-time drawing a current above the hold current of the dimmer.

A lamp having a narrow conduction interval typically has a peak rectifier at the input. However, the conduction interval can also narrowed intentionally by forcing "early disconnect" in order to minimize the energy intake. Alternatively or additionally said first type of lamp may be characterized by a repetitive peak current (RPC) on leading edge (because of the optional peak rectifier) with a significant falling edge i.e. a strongly negative dI/dt.

A lamp of second type showing a "wide conduction interval" is configured to prevent disconnect of the dimmer, i.e. keeping the TRIAC in conduction substantially until the zero-crossing of the alternating input voltage. This is typically achieved by drawing sufficient current (above the hold current) by the respective lamp in each period or half-cycle of said alternating phase-cut voltage.

Typically lamps of said second type operate as a (non)-linear resistive load, e.g. corresponding to an incandescent lamp. Furthermore, LED lamps comprising a linear driver may also show said wide conduction interval. The percentage of the time when the lamp is drawing a current above the hold current of the dimmer is typically more than 90%, preferably more than 95% or most preferred more than 98% of the respective ON-time of the dimmer.

There are also lamps of mixed types, i.e. characterized by a narrow conduction interval in a first half cycle and characterized by a wide conduction interval in another half cycle. There might be an unequal number of half cycles in which the lamp shows said narrow and/or wide conduction interval behavior. A corresponding lamp however may be configured to apply said wide conduction interval not in every half-cycle, but at least every 10 half-cycles or more frequent. The before mentioned operation is also referred to as "intended wide conduction interval operation". In the context of this invention such lamps are lamps of second type.

To cope with the aforementioned phenomenon, a circuit arrangement and a LED lamp is proposed according to a first aspect of the invention that provides an additional current pulse or "boost peak" in the input current/voltage at about the instant when the negative current slope of another lamp in the same group with narrow conduction interval is taking place.

The present inventors observed that if said additional boost peak is provided between 200-700 μs and preferably about 230 μs after the rising edge of a LE dimmer most robust suppression of above mentioned oscillation and therefore stable light output conditions are obtained. This additional boost current is in particular needed if at least one lamp of said first type is combined on a single dimmer with at least one lamp of said second type, i.e. said "mixed-load" configuration.

Said additional current pulse will temporally change the negative dI/dt in the dimmer caused by the lamp(s) of said first type into a positive or at least significant less negative dI/dt in the most critical phase, which is the "tail phase" of the RPC of the lamps of said first type. Thereby an eventual oscillation is prevented or at least attenuated, so that the unintentional disconnect of the dimmer can be advantageously avoided.

One of the strengths of the invention is that it can be implemented in a (separate) circuit arrangement for connection to said dimmer, a LED lamp with corresponding (driver) circuitry or even in software of an existing electronics device, i.e. a microprocessor, microcontroller or computing unit.

The circuit arrangement according to the present invention can be used for operating at least one lighting unit with a phase-cut power supply, and in particular a low-power lighting unit.

In this context, a low-power lighting unit preferably, but not exclusively, refers to a lighting unit comprising a solid state light source, e.g. an LED unit, such as an inorganic LED, organic LED, a solid state laser or the like. The lighting unit may certainly comprise more than one of the before mentioned components, connected in series and/or in parallel. The term "low-power" relates to the power consumption of the lighting unit compared to that of a conventional lighting means like an incandescent bulb. The power consumption of the at least one lighting unit is preferably below 20 W, more preferably below 15 W, most preferably below 10 W. Particularly low values are applicable if a single LED (or only a few LEDs) is operated. However, the present invention is not limited to operating a single LED.

The phase-cut power supply provides a phase-cut operating voltage, which basically is a sinusoidal voltage, where a part of each wave/cycle (or usually each half-wave/half-cycle) is chopped or cut out. Starting from a zero crossing of the alternating voltage, this may be the leading-edge part or the trailing-edge part.

Although the phase-cut power supply in this context usually comprises a "dimmer", e.g. a phase-cut dimmer, sometimes also referred to as "phase firing controller", in the sense that the part of the wave (or the envelope, respectively) that is chopped—which corresponds to the timing of the phase-cut—can be adjusted by an operator, it is also conceivable that this part is constant. Anyway, the time evolution of the voltage (or the envelope, respectively) shows a comparably steep decline or rise on each phase-cut operation. Any phase-cut technology known in the art may be used in context with the present invention.

The inventive circuit arrangement comprises an input for receiving said phase-cut operating voltage and thus may be adapted for connection to the power supply. Additionally or alternatively, the circuit further may comprise an output for connection to the at least one lighting unit. Each of the input and output may be formed by a permanent electrical connection, for example by soldering, or by a detachable connection, like a plug and socket connection. Of course, each of the mentioned connections may be switchable. Further, the connections may be indirect, but are preferably direct. Anyhow, the connections have to be electrically conductive at least in an operational state.

The inventive circuit arrangement furthermore comprises a pulse injection circuit, configured to determine a phase-cut operation of said power supply and to draw a current pulse from said power supply within a delay time between 200-700 μs after said phase-cut operation. In the present context, the term "delay time" refers to the time between the phase-cut operation, e.g. a leading edge, and the maximum or peak of the current pulse. A leading edge preferably corresponds to the moment at which the voltage increases from substantially zero Volt to the respective voltage according to the mains cycle. Depending on the dimmer, the duration of said edge may vary between a few to tens of microseconds.

The delay time may be predetermined or, as discussed in the following, be a function of one or more parameters, such as the ON-time of the LE dimmer.

The current pulse may be provided by any suitable means for drawing an additional current from the power supply. This may be provided, e.g., by connecting a low-resistance element to the power supply or by reducing the resistance of a permanently connected element. Alternatively or additionally, the current pulse may be drawn by a current source and/or a switch mode converter. Said current source may preferably be part of a linear driver, most preferably part of a tapped linear driver, also referred to as "direct mains driver", which can be configured to provide said current peak according to the invention.

The pulse injection circuit may comprise any suitable means to provide said at least one current pulse. Preferably, the pulse injection circuit comprises a phase-cut timing detector, connected with said input and adapted to determine a phase-cut operation of said power supply, a controllable delay unit, connected with said phase-cut timing detector and configured to provide a trigger signal after a delay in response to said phase-cut operation and a current pulse injector, connected with said delay unit and said input to draw said at least one current pulse from said phase-cut power supply upon reception of said trigger signal, within said delay time of 200-700 μs.

The phase-cut timing detector may be of any suitable type to determine the phase-cut operation, e.g. the above mentioned leading-edge. The delay unit is controllable, i.e. adapted to initiate the delay when a phase-cut operation is determined. Certainly, the delay unit may further be adapted to be controllable in terms of a variable delay, provided at a corresponding input, detected dim level and/or presence of other lamps, etc. Preferably, the phase-cut timing detector is adapted for operation with a leading edge phase-cut power supply/dimmer (LE dimmer), where said phase-cut operation corresponds to a leading edge.

The current pulse injector may be of any suitable type to provide said current pulse and e.g. be adapted to provide a pulsed load to the phase-cut power supply. For example, the pulse injector may comprise a switchable load circuit that is connected to the input and that is adapted to provide an electrical load at least temporarily to the phase-cut power supply during operation.

The present embodiment provides that, in addition to the load of the lighting unit, e.g. connected to the output of the circuit arrangement during operation, a switchable, additional electrical load is present. Advantageously, it is thus possible to provide an increase in the load independent from the lighting unit.

Certainly, different embodiments regarding the pulse injector are conceivable. For instance, the pulse injector may comprise a dissipative and/or non-dissipative current source, an adjustable current source, a controllable bleeding circuit, a tapped buck converter, a linear converter, a tapped linear converter and/or a power factor correction device.

Preferably, said controllable bleeding circuit comprises at least a controllable switching device and a resistive element. Alternatively or additionally, said power factor correction device may be a boost, buck-boost or flyback converter.

Preferably in a non-dissipative example, the pulse injector may comprise a buffering device, e.g. a buffer capacitor, to store the drawn current by the pulse and to provide the current to the LED unit. Accordingly in this embodiment, the efficiency of the setup is further improved. In the example of a power factor correction device, said power factor correction device may comprise an according energy storage or buffer unit, which is charged at least by said current pulse and provides power to said at least one lighting unit.

Regarding the above-mentioned connections of the pulse injector and the circuit arrangement, it is preferred that these connections are permanent and that these elements are integrated and/or form part of an integrated circuit.

According to a preferred embodiment said current pulse or boost current peak is applied (maximum of this peak) between 200 and 700 μs, preferably between 200 and 500 μs, most preferably after 230 μs after the start of the phase-cut operation (delay time), i.e. after said leading edge (in the following referred to as "LE" of the power supply/dimmer). A variety of pulse forms may be used, e.g. exponentially decaying pulses.

Preferably, the current pulse has a maximum derivate, lower than a predefined steepness value. The present embodiment provides a particularly advantageous suppression of the oscillation that may cause the aforementioned unintentional disconnect of the dimmer. Most preferably, the falling edge of the current pulse has a maximum derivate, lower than a predefined steepness value. The general idea of the present embodiment is that the rising edge of the pulse can be steep but the falling edge of the current pulse should be shallow enough not to induce the oscillation that may cause the mentioned disconnect of the dimmer. Preferably, the predefined steepness value is approx. 1-2 mA/μs, so that the falling edge of the current pulse should have a gradient of max. 2 mA/μs. Certainly, the exact value depends on the dimmer LC combination and equivalent LC of any eventual EMI filter of the connected lamps and the amplitude of the current (compensation) pulse. Those values may be different for US and for EU type of designs.

According to a further preferred embodiment said boost current peak has no sharp edges, i.e. it does not have strong dI/dt itself. Examples are Gaussian or Lorentz type peak shapes and saw tooth like shapes, with or without holding plateau.

Preferably, said current pulse reduces the total dI/dt of all currents of all lamps attached to a single dimmer (i.e. measured at the dimmer) significantly in the range between 200 and 500 μs after the rising edge of the LE dimmer. Significant reduction of dI/dt is understood in this context that the present embodiment damps the strong negative dI/dt to almost neutral or even slightly positive dI/dt in a mixed installation of lamps of said first type and at least one lamp of said second type.

According to a preferred embodiment, the time when said current pulse is applied after the leading-edge is set in dependence of the ON-time of the dimmer/power supply. In this embodiment, the delay time thus is a function of the dimming level of the dimmer.

As discussed above, the term ON-time or "t_on"-time refers to the time between the phase-cut operation and a subsequent zero-crossing of an e.g. alternating operating voltage, corresponding to the conduction phase or interval of the dimmer. Consequently a smaller ON-time corresponds to a lower dim level or lower brightness of a connected lighting unit, whereas a larger ON-time corresponds to a higher dim level or higher brightness. The present embodiment allows to enhance the stability of the dimmer.

Preferably, the delay unit is configured to increase the delay (gradually) when the ON-time of the dimmer increases. Most preferably, the delay unit is configured to increase the delay, so that the delay time is between 200-400 μs at t_on=2 ms to about 500-600 μs at t_on=5 ms. The ON-time of 5 ms corresponds to a conduction angle of 90 degrees assuming 230V mains and 50 Hz mains frequency.

According to an embodiment, said current pulse is applied at all dim levels. However, according to a preferred embodiment said current pulse is applied for dim levels in the range between 18 degrees and 90 degrees phase cut angle, which corresponds to an ON-time between 1 ms and 5 ms, respectively.

According to another embodiment said boost current pulse is applied for dim levels in the range between 36 deg and 71 deg phase cut angle (which corresponds to an ON-time between 2 ms and 4 ms, respectively).

To allow the above determination of the delay time as a function of the dim level, it might be necessary to determine the timing of the phase cut edge in the respective half cycle of the alternating operating voltage, i.e. between two subsequent zero-crossings of the operating voltage. Various possibilities exist to obtain the timing or dimming level information.

According to a preferred embodiment, the circuit comprises a zero-crossing detector, connected with said pulse injection circuit to provide zero-crossing timing information of said phase-cut operating voltage. Accordingly, the zero-crossing detector together with said phase-cut timing detector allows to determine the ON-time, i.e. the time between the phase-cut operation and a subsequent zero-crossing, i.e. the dimming level.

The pulse injector according to the invention may be adapted to provide at least one current pulse with a given amplitude and shape. According to a preferred embodiment said current pulse has a typical width (duration of pulse=width=FWHM=full width half maximum)) between 100 and 500 μs, preferably between 150 and 300 μs.

The pulse amplitude may be chosen in accordance with the application. Preferably, said current pulse has a typical height, i.e. peak current value of additional pulse on top of current drawn by lighting units, between 20 and 700 mA, preferably between 25 and 400 mA and most preferably between 25 and 200 mA. According a preferred embodiment said current pulse provides a typical average power drawn between 150 and 800 mW, preferably between 200 and 500 mW.

However, the pulse injector does not necessarily be configured to draw current pulses to a constant amplitude or shape. Therefore in a further preferred embodiment, the pulse injector may be configured to adapt the amplitude and/or shape of the current pulse in dependence of the ON-time. Here, the height and/or width of the pulses is not fixed, but depends on the phase-cut angle, i.e. the dim level.

For a leading-edge dimmer, for instance, a phase-cut angle of 90° (corresponding to half of the sine-wave being cut off) may result in relatively high pulses, while a low phase-cut angle, e.g. 30°, (corresponding a smaller part of the sine wave being cut off) will result in lower pulses. In the first case, a connected lighting unit dissipates less energy than in the second case. Therefore the pulse injector may be adapted to apply more additional load in the first case to guarantee proper functioning of the phase-cut power supply. In the second case, the pulse-amplitude dependence helps to lower the dissipated power at high dim level (i.e. high light output), where the lamp power (and thermal load of a heat-sink) is high and the power-dissipation is important.

In the above exemplary embodiments, the pulse injector determined the amplitude and/or the shape of the current pulse in dependence of the ON-time of the dimmer. Alternatively or additionally and according to a further preferred embodiment of the invention, the circuit arrangement further comprises a voltage detection circuit, coupled with said pulse injection circuit to provide a voltage signal, indicative of the voltage at said input, said pulse injection circuit being configured to set the delay time and/or the amplitude of said current pulse in dependence of said voltage signal.

According to the present embodiment, the voltage detection circuit advantageously provides the voltage signal, so that the pulse injection circuit, e.g. the current pulse injector and/or the controllable delay unit may adapt the timing and/or the amplitude in dependence of the voltage at the input.

For example, the delay within the delay time of 200-700 μs and/or the amplitude of the current pulse may be adapted in dependence of the detection of an "early disconnect" of the phase-cut power supply, i.e. before the zero-crossing, so that the delay and the pulse amplitude can be optimized to prevent said "early disconnect" most efficiently.

Accordingly, it is preferred that the voltage detection circuit "observes" the voltage at the input terminals. The dV/dt of the voltage, i.e. its gradient, is a condition for detecting disconnect of the TRIAC of the dimmer. The voltage detection circuit may thus be configured to determine the derivative of the phase-cut operating voltage and compare the derivative with a predefined gradient waveform. The predefined gradient waveform may, e.g. correspond to the gradient of a typical sinusoidal mains waveform. As will be apparent to one skilled in the art, the gradient waveform in this case corresponds to the cosine of the sinusoidal waveform.

If the dV/dt of the voltage does not substantially correspond to the value that is expected according to the given position of the predefined gradient waveform, then the "early disconnect" of the dimmer has occurred. In the present context, the term "substantially corresponds" is understood to include slight deviations of +/−10V, so that an "early disconnect" is only determined in case the dV/dt departs from the expected value of the predefined gradient waveform by the range mentioned above. Accordingly in the present embodiment, the voltage signal is compared with a stored expected shape of the voltage and to determine said "early disconnect" when the voltage signal is "distorted".

Certainly, various alternatives to detect said "early disconnect" exist. For example, the detection circuit could be configured to apply a "test loading" phase/event by drawing a current from the dimmer until the zero-crossing and observe the voltage. During test loading, the circuit arrangement is configured to draw a current from the power supply, which current is lower than the minimum holding current of the dimmer, such that this current alone will not be sufficient to keep the TRIAC of the dimmer in conduction. In case the lamp can actually draw this current, the TRIAC has to be in conductive state, i.e. due to the current flow to the other load. In case the test loading current can not be drawn, the "early disconnect" has occurred. To provide the test loading, the circuit arrangement may comprise a controllable current sink. The current sink may provide a feedback signal, indicating whether the programmed current is actually flowing.

Preferably upon the determination of an "early disconnect" of the power-supply, the controllable delay unit is configured in an iterative procedure to vary the delay time and to subsequently determine, whether an "early disconnect" occurred. The method ends when no "early disconnect" is determined after varying the delay time. Most preferably, the delay unit is configured to vary the delay time by an increment, smaller than the total delay range of 200-700 μs, so that multiple increments are possible. Further preferred, the increment is less than one tenth of the total delay range.

Correspondingly, the pulse injector may alternatively or additionally, be configured in an iterative procedure to vary the pulse amplitude and to subsequently determine, whether an "early disconnect" occurred. Also here, the method ends when no "early disconnect" is determined. Preferably, the pulse amplitude is varied, i.e. increased or decreased by an increment, smaller than the total amplitude range of 20 to 700 mA. Further preferred, the increment is less than one tenth of the total amplitude range.

Both of the before mentioned embodiments may be combined, i.e. the controllable delay unit and the pulse injector may be configured in a first iterative procedure to vary the delay time and to subsequently determine, whether an "early disconnect" occurred and then in a second iterative procedure to vary the pulse amplitude and to subsequently determine, whether an "early disconnect" occurred. Here, the delay unit first "tries" to prevent said "early disconnect" by only adapting the delay and then the pulse injector adapts the pulse amplitude in case the prevention of said "early disconnect" is not possible by only adapting the delay.

As an example, as long a "early disconnect" is detected, the delay in applying the programmed current waveform is increased with given time increments until either a preprogrammed limit is reached, or no "early disconnect" occurs. If the preprogrammed limit is reached, the current waveform is changed in a first step, the delay time is set to the minimum and waveform is applied, again with the increasing delay. For changing the waveform, the parameters of peak amplitude, peak duration, value during the rest of the current intake interval and duration of the rest can be changed. Preferably, a change in peak amplitude or duration is compensated by an opposing change in value or duration during the rest of the interval, the opposing change being weighted by the instantaneous input voltage at each point in time, such that the power intake of the lamp remains stable.

The presence of said current pulse can be easily detected by a current measuring device placed in the circuitry between dimmer and lamps. E.g. on an oscilloscope one can easily measure the presence of said current peak.

The pulse injector in an embodiment may be configured to draw multiple current pulses. For example, the pulse injector may be configured to draw a current pulse upon each phase-cut operation.

According to a development of the invention, said additional boost current peak is not applied in each half cycle but only in regular, predefined intervals, e.g. each 3rd, 5th, 7th, 9th . . . half cycle or phase-cut operation. Accordingly, the current pulse injector may be configured to draw a current pulse in predetermined intervals. Most preferably, the current pulse is drawn in the same half-cycle, in which at least one of the lamps (at the dimmer) draws continuously a current from the edge substantially to the zero-crossing. Thus, in the phase or half-cycle where a disconnect of the dimmer needs to be avoided.

According to another preferred embodiment said additional boost current pulses is applied in the half-cycles when "test loading" occurs, i.e. when a current wave shape is applied that keeps the TRIAC in conduction substantially/almost until the zero crossing of the mains, i.e. the before mentioned intended wide conduction interval operation. During half-cycles where a narrow conduction interval is applied, the current pulse injector is disabled so that no current pulse is generated. This has the advantage that it is an even more energy efficient solution.

Preferably, the pulse injector comprises a buffering device to store the current or energy drawn by the pulse and to provide the stored current/energy to the at least one lighting unit. The present embodiment enhances the energy efficiency of the circuit arrangement further, since here, the electrical energy obtained from the power supply is provided to the load and not dissipated.

Most preferably, the circuit arrangement comprises a detection circuit with a lamp compatibility detector. The detection circuit allows to determine, whether a parallel lamp is present, so that the current pulse is advantageously only then generated, when necessary, i.e. when at least one parallel lamp is also connected to the phase-cut power supply. Accordingly, said current pulses are only provided in a "compatibility mode" of the circuit arrangement/LED driver circuit. Details of the detection circuit and its operation are in the following discussed with reference to a second aspect of the invention.

Further processing of the phase-cut voltage and determination of the phase-cut operation is facilitated if the voltage is rectified. Therefore, in a preferred embodiment of the invention the input comprises a rectifier. The output may preferably comprise LED driving circuitry, i.e. being configured to provide an operating voltage/current to power the at least one lighting unit/LED. Most preferably, the output comprises a buffering device, e.g. a suitable capacitor and/or is connected to the buffering device of the pulse injector.

In a further embodiment of the invention, the circuit arrangement is a LED driver circuit, i.e. comprising an input for receiving said phase-cut operating voltage from said power supply and an output for connection to at least one LED unit. In particular in the latter case, a LED lamp may be provided comprising a circuit arrangement/LED driver circuit according to one or more of the preceding embodiments and at least one LED unit, connected to the output of the circuit arrangement/LED driver circuit.

The circuit arrangement according to the present aspect of the invention may be realized using analog elements. However, as will be appreciated by those skilled in the art, it could also be implemented using digital components or in computer software. In this regard, the term "computer" may include a digital core, a microprocessor, a DSP, a state machine, etc.

According to the present aspect of the invention, a method of operating at least one lighting unit with a circuit arrangement is provided, said circuit arrangement comprising an input for receiving a phase-cut operating voltage from a power supply and/or an output for connection to said at least one low-power lighting unit, wherein a phase-cut operation of said power supply is determined and a current pulse is drawn from said power supply within a delay time between 200-700 μs after said phase-cut operation. In the above method, the circuit arrangement certainly may be adapted according one or more of the preferred embodiments discussed in the preceding.

A second aspect of the present invention relates to a detection circuit for connection to a LED driver circuit having an input for receiving a phase-cut operating voltage from a power supply and a lamp compatibility detector device, configured to determine the presence of a parallel lamp, e.g. a lamp having a narrow conduction interval, connected to said phase-cut power supply during operation and to provide a compatibility signal, indicative of the presence of said parallel lamp to said LED driver circuit, so that the driver circuit is set between a normal operating mode and a compatibility mode in dependence of the presence of said parallel lamp.

As discussed above, when combining an improved power factor or second type of lamp, having a wide conduction interval, with said first type of a lamp, it may be beneficial for present driver/lamp to provide counteractions, such as e.g. providing said additional boost current pulse and/or mimic the current wave shape of the first type of lamps, i.e. operate in a "compatibility mode" as explained in the following.

However, all possible counteractions make the LED lamp less efficient and/or may impair the dimmer compatibility. It would therefore be advantageous if said counteraction is only applied when it is really needed, i.e. when the presence of a parallel lamp is determined. Consequently the present aspect of the invention allows to determine the presence (or absence) of other lamp(s), in particular a lamp of the above mentioned first type having a narrow conduction interval at the same dimmer and thus parallel to the detection circuit.

In the present context, the term "presence" is understood that said parallel lamp is connected to the same phase-cut power supply, e.g. in parallel to the detection circuit. The parallel lamp may or may not be in direct physical proximity to the detection circuit.

The detection circuit according to the present aspect comprises an input for receiving a phase-cut operating voltage from an accordingly connected power supply and a lamp compatibility detector, which is configured to determine the presence of said at least one parallel lamp. As discussed above, the power supply may in particular be a phase-cut power supply.

The phase-cut power supply provides a phase-cut operating voltage, which basically is a sinusoidal voltage, where a part of each wave/cycle (or usually each half-wave/half-cycle) is chopped or cut out. Starting from a zero crossing of the alternating voltage, this may be the leading-edge part or the trailing-edge part.

Although the phase-cut power supply in this context usually comprises a "dimmer", e.g. a phase-cut dimmer, sometimes also referred to as "phase firing controller", in the sense that the part of the wave (or the envelope, respectively) that is chopped—which corresponds to the timing of the phase-cut—can be adjusted by an operator, it is also conceivable that this part is constant. Anyway, the time evolution of the voltage (or the envelope, respectively) shows a comparably steep decline or rise on each phase-cut operation. Any phase-cut technology known in the art may be used in context with the present invention.

The input may be formed by a permanent electrical connection, for example by soldering, or by a detachable connection, like a plug and socket connection. Of course, each of the mentioned connections may be switchable. Further, the connections may be indirect, but are preferably direct. Anyhow, the connections have to be electrically conductive at least in an operational state.

The lamp compatibility detector is at least in an operational state connected with said input and may be of any suitable type to determine the presence of the parallel lamp. The detector may certainly be integrated with further components, in particular in case the detection circuit is formed with the circuit arrangement according to the first aspect of the invention and/or a LED driver circuit. Most preferably, the detector comprises a microcontroller, -processor or the like with a suitable programming for detection of the parallel lamp. The connection of the lamp compatibility detector with the LED driver circuit may be of any suitable wired or wireless type, like a soldering or detachable connection, e.g. a plug and socket connection.

The lamp compatibility detector of the detection circuit according to the present second aspect of the invention determines, whether a lamp is connected to the same power supply in parallel. The provided compatibility signal allows to set the operation of the connected LED driver circuit to the normal or compatibility mode. Although the detection circuit according to the present aspect of the invention may be provided separate from a LED lamp, it is preferred that the detection circuit is integrated with an LED lamp and/or a LED driver circuit. In the case of a "standalone" detection circuit, the detector should preferably be connected to the LED driver circuit using a suitable wired or wireless control connection to transmit the compatibility signal.

The detection could be conducted at regular intervals during operation of the detection circuit. Preferably, the determination of the presence of said parallel lamp is conducted upon connection of the detection circuit with power, i.e. during an initialization period. Thus, it is particularly preferred that the lamp compatibility detector is operational for the duration of the initialization period.

After connection with power, the parallel lamp typically would start working immediately since the power has appeared on its input terminals. Accordingly, the detector device will "listen", e.g. for several mains cycles and "learn" in this way whether any parallel lamp is present.

Preferably in this case, the proposed circuit should be seen by the dimmer as a high impedance during "listen", i.e. during the initialization period, so that re-firing of the dimmer and appearance of phase-cut voltage at the input terminals of the circuit is avoided. Thus, the input should preferably have a high (input) impedance of greater than 100 kOhm. If providing a high impedance is not feasible from practical point of view the circuit should provide an impedance that is high enough for keeping the dimmer from triggering for at least one mains half-cycle.

Most preferably, the initialization period has a duration between 1 half-cycle of the phase-cut operating voltage and 40 half-cycles, i.e. 20 full cycles, particularly preferred between 2 half-cycles and 10 half-cycles. For example and considering a 50 Hz operating voltage, the initialization period should be between 10 ms and 400 ms, particularly between 20 ms and 100 ms.

According to a further embodiment of the invention the result of said detection is stored in a storage unit, e.g. a semiconductor memory such random access memory, to keep the result and thus the setting of the compatibility signal even after the initialization period until the lamp is switched off or a reset or "reprogramming" occurs.

As will become apparent to one skilled in the art, multiple alternatives exist to determine said parallel lamp, which certainly also may depend on the respective type of parallel lamp. In a simple embodiment, the detector may be adapted to determine the impedance between the input terminals to detect a parallel connected lamp.

In case the parallel lamp is of first type, i.e. a lamp with a narrow conduction interval, it is advantageous to determine the presence of the lamp by analyzing the voltage waveform during operation. According to a preferred embodiment, the lamp compatibility detector accordingly comprises a voltage detection circuit, connected with said input and configured to determine said compatibility signal from said phase-cut operating voltage and in particular from the voltage waveform, i.e. the time development of the voltage.

In the present context, the terms "narrow conduction interval" and "wide conduction interval" relate to a percentage of the time, in which the respective lamp draws sufficient current (above the hold current of the phase-cut power-supply/dimmer) to keep the dimmer in conduction compared to the nominal ON-time of a dimmer. The ON-time for a leading edge (LE) type of dimmer corresponds to the time between phase cut edge initiated by the dimmer and next zero-crossing of an alternating phase-cut operating (mains) voltage.

A lamp of first type having a narrow conduction interval will typically show a disconnect phase of the dimmer, i.e. the TRIAC of the dimmer switches off before the next zero-crossing. Said disconnect phase of said first type of lamps typically is more than 0.5 ms, preferably 1 ms and most preferred 1.5 ms per half-cycle of the alternating operating voltage, which certainly may depend on the dim level.

A lamp of first type (narrow conduction interval) is characterized by a percentage of less than 95%, preferably less than 80% and most preferred less than 50% of the ON-time drawing a current above the hold current of the dimmer.

A lamp having a narrow conduction interval typically has a peak rectifier at the input. However, the conduction interval can also narrowed intentionally by forcing "early disconnect" in order to minimize the energy intake. Alternatively or additionally said first type of lamp may be characterized by a repetitive peak current (RPC) on leading edge (because of the optional beak rectifier) with a significant falling edge i.e. a strongly negative dI/dt.

The detector additionally or alternatively may be configured to detect the falling edge to determine the presence of said additional lamp, i.e. the negative dV/dt caused by the disconnect of the additional lamp. Preferably, the voltage detection circuit is configured to determine the derivative of the phase-cut operating voltage, to compare the derivative with a predefined gradient waveform and to set said compatibility signal to indicate said parallel lamp, when the derivative of the operating voltage at a given time does not substantially correspond to said predefined gradient waveform.

Accordingly, it is preferred that the voltage detection circuit "observes" the voltage at the input terminals. The dV/dt of the voltage, i.e. its gradient, is a condition for detecting disconnect of the TRIAC of the dimmer. The voltage detection circuit may thus be configured to determine the derivative of the phase-cut operating voltage and compare the derivative with a predefined gradient waveform. The predefined gradient waveform may, e.g. correspond to the gradient of a typical sinusoidal mains waveform. As will be apparent to one skilled in the art, the gradient waveform in this case corresponds to the cosine of the sinusoidal waveform.

If the gradient of the voltage does not substantially correspond to the value that is expected according to the given time position of the predefined gradient waveform, then the "early disconnect" of the dimmer has occurred and thus a parallel lamp is present.

In this context, the term "substantially corresponds" is understood to include slight deviations of +/−10V, so that an "early disconnect" is only determined in case the dV/dt departs from the expected value of the predefined gradient waveform by the range mentioned above. Accordingly in the present embodiment, the voltage signal is compared with a stored expected shape of the voltage and to determine said "early disconnect" when the voltage signal is "distorted", i.e. deviating from an ideal sinusoidal shape.

In the above embodiment for example, the voltage detection circuit e.g. during an initialization period "observes" the voltage at the input terminals. The dV/dt of the voltage is a condition for detecting disconnect of the TRIAC of the dimmer and thus the presence of said parallel lamp of first type, i.e. the determination of a falling edge in the voltage at the input. If the dV/dt of the voltage departs from the value that is expected from a given position of sine wave is observed, then the "early disconnect" of the dimmer has occurred, which is taken as an indication of the presence of said parallel lamp.

The present embodiment is based on the recognition, that the steepest dV/dt that can occur if the parallel lamp is still "connected" to the mains via the dimmer is the dV/dt of the mains voltage in the present half-cycle. If the lamp is disconnected, i.e. a falling edge is present, the dV/dt will typically depart substantially from an ideal sinusoidal shape, because the lamp will drain the capacitors connected to the power line, e.g. an AC line (EMI filters of the lamps and snubber capacitor of the dimmer) very quickly.

As mentioned above, various alternatives to detect said parallel lamp exist. For example, the detector could be configured to apply a "test loading" phase/event by drawing a current from the dimmer until the zero-crossing and observe the voltage. During test loading, the detection circuit is configured to draw a current from the power supply, which current is lower than the minimum holding current of the dimmer, such that this current alone will not be sufficient to keep the TRIAC of the dimmer in conduction. In case the lamp can actually draw this current, the TRIAC has to be in conductive state, i.e. due to the current flow to the other load. In case the test loading current can not be drawn, the "early disconnect" has occurred. To provide the test loading, the detection circuit may comprise a controllable current sink. The current sink may provide a feedback signal, indicating whether the programmed current is actually flowing.

Alternatively or additionally, the detector may configured to compare the waveform at the input to a (stored) expected shape to determine the presence of said parallel lamp.

In a further alternative or additional embodiment and in case the detection circuit is formed with a circuit arrangement according to the first aspect, it is possible to observe an internal voltage of the circuit arrangement. Here, fluctuations could be observed due to a different current pulse waveform when said first type of lamp is present. As an example, with some switch mode power supply topologies, the change in output voltage is related to the input voltage. When the output voltage changes differently than what is expected according to the applied load and control parameter, this is an indication that the input voltage is not as expected.

According to another preferred embodiment, the lamp compatibility detector comprises a phase-cut timing detector and a zero-crossing detector. The phase-cut detector is connected with the input and configured to determine a phase-cut operation of said power supply, e.g. the leading edge as described above. The zero-crossing detector is also connected with the input and is configured to provide zero-crossing timing information of said phase-cut operating voltage. A parallel lamp and in this case a parallel lamp of first type, i.e. having a narrow conduction interval, is determined when a phase-cut operation of the dimmer is detected between each zero-crossing of the phase-cut voltage, i.e. in each half-cycle.

The present inventors have determined, that a parallel lamp of first type causes a corresponding dimmer edge not only in each positive half-cycle, as would be the case without any further lamp attached due to the behavior of the dimmer, but also in each negative half-cycle. The present embodiment thus allows a very reliable determination of a parallel lamp of said first type.

Preferably, the detection circuit and/or the phase-cut timing detector is adapted for operation with a leading edge phase-cut power supply/dimmer (LE dimmer), where said phase-cut operation corresponds to a leading edge.

The detection circuit according to the present aspect of the invention may be realized using analog elements. However, as will be appreciated by those skilled in the art, it could also be implemented using digital components or in computer software. In this regard, the term "computer" may include a digital core, a microprocessor, a DSP, a state machine, etc.

In a method of detecting a connected parallel lamp with a detection circuit for connection to a LED driver circuit, the presence of the parallel lamp, connected in parallel with the detection circuit to said phase-cut power supply during operation is determined and a compatibility signal is provided to said driver circuit, wherein said compatibility signal is indicative of the presence of said first type of lamp so that the LED driver circuit is set between a normal operating mode and a compatibility mode in dependence of the presence of said parallel lamp.

In the above method, the detection circuit certainly may be adapted according one or more of the preferred embodiments discussed in the preceding.

The present invention further concerns a LED driver circuit with at least an input, an output and a controllable power converter. The input is adapted for receiving a phase-cut operating voltage from a power supply. The output is adapted for connection to at least one LED unit. The controllable power converter is connected to the input and the output to provide an operating current for said LED unit from the phase-cut operating voltage. The power converter is adapted to recurrently draw an input current from said power supply for the duration of conduction interval. The power converter is further configured to operate in a normal operating mode and a compatibility mode, where said conduction interval in said compatibility mode is shorter than in said normal operating mode.

The present aspect of the invention allows the LED driver circuit to be operated in two operating modes, e.g. set using a corresponding switch. Herein, the LED unit comprises at least one LED, such as an inorganic LED, organic LED, a solid state laser or the like. The LED unit may certainly comprise more than one of the before mentioned components, connected in series and/or in parallel.

As mentioned in the preceding, problems may arise in a mixed-load configurations, i.e. in an arrangement where lamps or driver circuits of a first type, i.e. with a narrow conduction interval, are combined with lamps that employ the principle of energy intake during a wide conduction interval, in the following referred to as "improved power factor lamp" or "second type of lamp", e.g. connected in parallel to said first type of lamp. Here, the early interruption of energy delivery to the lamp with (intended) wide conduction interval may cause one of the following failures, resulting in an unacceptable light output and/or optical flicker: "early disconnect" of dimmer (especially random or not identical for all lamps and/or at each half cycle), fluctuations in floating (operating) voltage, jitter of edge position, failure of zero-crossing detection mechanism and disappearance of floating (operating) voltage at the lamps.

According to the above example of said "compatibility mode", the driver circuit would normally be operated with a significantly wider conduction interval, i.e. in a "normal operating mode", eventually comprising a substantially constant hold current at a predefined level. To prevent the mixed load incompatibility, the driver circuit could be set to the compatibility mode with reduced conduction interval and/or high repetitive peak current. Here, the driver "mimics" the operation of a lamp of first type, e.g. having an only small conduction interval. In the present context, the term "conduction interval" relates to a period, where the LED driver circuit is supplied with a current by the power supply. Preferably, the duration of the conduction interval in the compatibility mode is less than 50%, most preferably less than 25% and particularly preferred less than 10% of the duration of the conduction interval in the normal operating mode.

As mentioned above, the power converter may be set between the normal and the compatibility mode by a switch, operated by a user. Preferably, the driver circuit comprises a detection circuit according to one or more of the above embodiments, where the lamp compatibility detector is connected with said power converter to set operating mode of the power converter in dependence of the compatibility signal. Preferably, the power converter is set to the compatibility mode when the compatibility signal indicates a parallel connected lamp.

The present invention also relates to a LED lamp comprising a LED driver circuit according to one or more of the above embodiments and at least one LED unit, connected to the output. Furthermore, a lighting system is provided comprising a phase-cut power supply and one or more connected LED lamps according to one or more of the above embodiments.

BRIEF DESCRIPTION OF THE DRAWINGS

These and other aspects, features and advantages of the present invention will be apparent from and elucidated with reference to the description of preferred embodiments in conjunction to the enclosed figures, in which.

DESCRIPTION OF EMBODIMENTS

A basic embodiment of a first aspect invention is in the following explained with reference to FIGS. 1-4. According to the present aspect of the invention it is proposed to provide a circuit arrangement which enhances the compatibility when operating multiple LED lamps in parallel with a phase-cut power supply dimmer. The circuit arrangement is adapted to draw an additional boost current pulse within a delay time of 200 to 700 μs which has been found to in particular reduce optical flicker in the output light of the LED lamps.

The present aspect of the invention is based on the recognition of the inventors that certain types of currently available LED lamps, in the following referred to as "first type of lamps" employ the principle of energy intake during a narrow conduction interval. The negative dI/dt that is created by the lamps with the narrow conduction interval induces an oscillation in the LC circuitry of a connected phase-cut power supply/dimmer and/or EMI filters of the lamps. On its turn this oscillation may cause a so-called "early disconnect" of a TRIAC, which typically is used in a phase-cut dimmer of the power supply as switching element.

In the context of dimmers and in particular leading edge (LE) type of dimmers, the term "early" or "unintentional" disconnect refers to a switching device of said LE dimmer, e.g. a TRIAC, being set to the non-conductive state at an undesired point in time, i.e. and with reference to a leading edge type of dimmer, before the zero crossing of an alternating input voltage.

In a mixed-load configuration, i.e. in an arrangement where lamps with the narrow conduction interval are combined with lamps that employ the principle of energy intake during a wide conduction interval, in the following referred to as "improved power factor lamp" or "second type of lamp", e.g. connected in parallel to said first type of lamp, this early interruption of energy delivery to the lamp with (intended) wide conduction interval may cause an unstable operation and/or flicker in the light output. Here, the application of the current pulse stabilizes the operation and reduces flicker.

Figure 1:
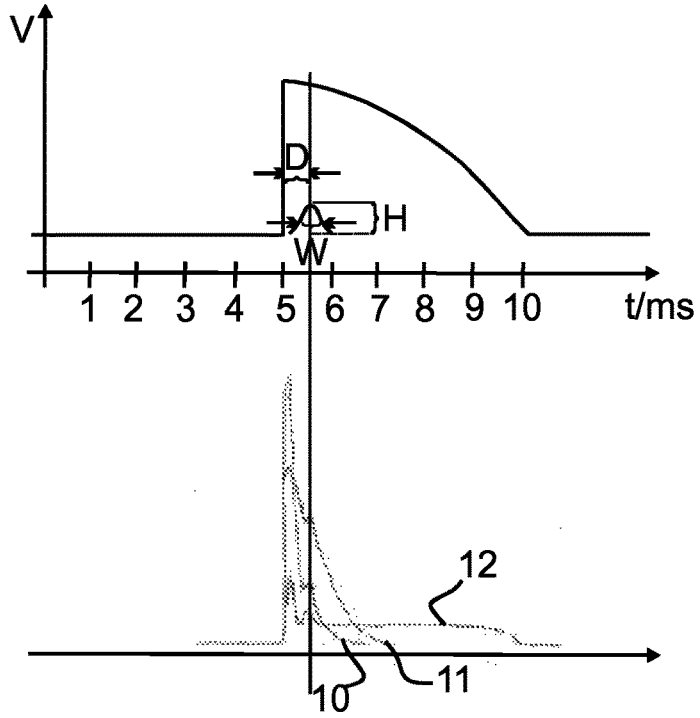
FIG. 1 schematically illustrates the application of a current pulse to a phase-cut operating voltage.

The upper part of the FIG. 1 shows an example of the phase-cut voltage provided by a leading-edge (LE) phase-cut power supply dimmer at about 90 degree phase angle (half of the sinusoidal operating voltage being cut-off), resulting in a dimmer ON-time of 5 ms or 50%. As will be apparent to one skilled in the art, only one half-cycle of the voltage is shown. The position of said additional boost current pulse in the lamp input current wave shape according to the present aspect is also depicted in the upper part of the Figure, which according to the present inventors' recognition should be provided with a delay time D between 200-700 μs after the phase-cut operation, i.e. the shown dimmer edge. The timing of the pulse relative to the edge is indicated as delay time D, the duration of the pulse is described as width W and the amplitude/height is indicated as H.

The lower part of FIG. 1 shows several possible embodiments, i.e. said additional boost pulse superimposed on different possible lamp input current wave shapes of a parallel connected lamp in dependence on different types of lamps. Reference numeral 10 indicates the resulting wave shape for a high repetitive peak current (RPC) type of lamp with little damping, 11 with more damping and 12 a resistive lamp load behavior, respectively. As can be seen, lamps having an RPC type of input current shape show a narrow conduction interval, while a resistive lamp conducts until the end of the respective half-cycle of the voltage, i.e. until the zero crossing.

Alternative to the shown wave shapes, it is also considered to be a realistic scenario that said additional boost current pulse appears after the lamp current input wave shape has approached zero.

Figure 2:
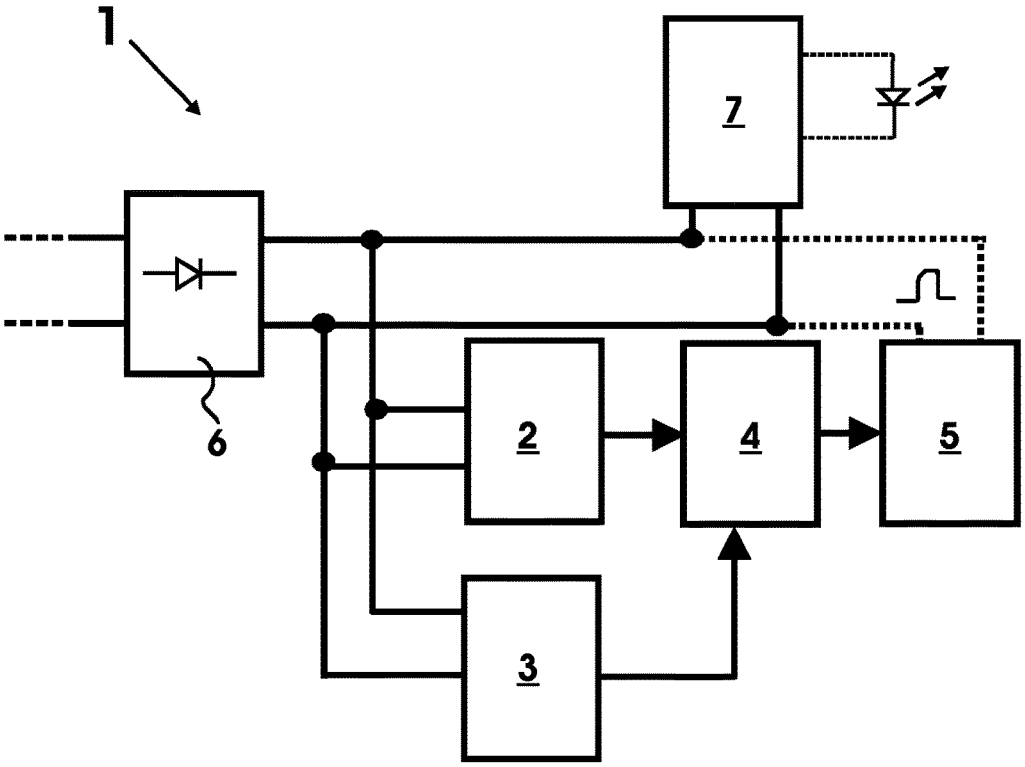
FIG. 2 shows an embodiment of the circuit arrangement according to a first aspect of the invention in a schematic block diagram.

The implementation of the circuit arrangement 1 according to an embodiment of the present aspect of the invention is shown in FIG. 2. The circuit arrangement 1 comprises an input 6 and an output 7, where the output 7 is exemplary connected to a LED. Thus, the circuit arrangement 1 is also referred to as LED driver circuit in the following.

Input 6 comprises a rectifier and connects the circuit 1 to the phase-cut power supply (not shown). The circuit 1 includes both an edge detector, i.e. phase-cut timing detector 2, and a zero-crossing detector 3 the output of both is provided to a variable delay unit 4 that provides a trigger signal for a given delay time (see table below). The waveform of the current pulse according to the desired shape is then formed or generated by current pulse injector 5 once the delayed trigger signal is received. The pulse having the desired waveform is then drawn from the power supply over input 6, as indicated by the dotted lines in FIG. 2.

Figure 3A:
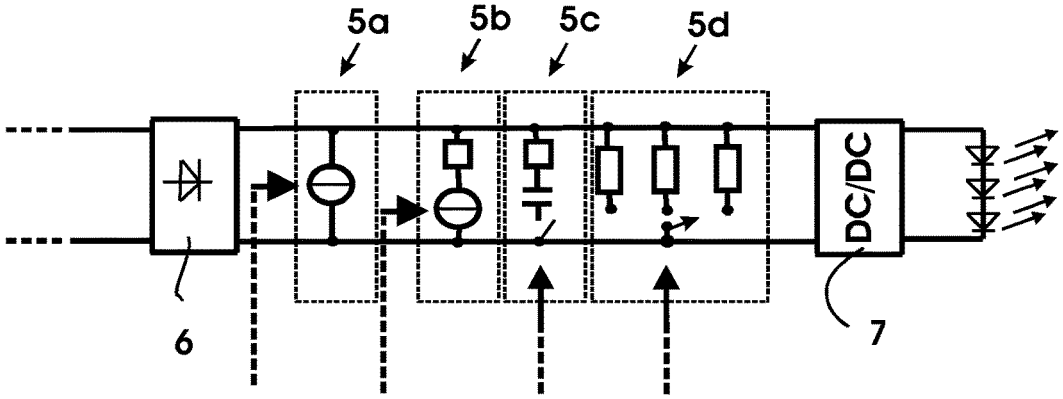
FIG. 3*a*-3*e* shows exemplary embodiments of suitable set-ups of a pulse injection circuit.
Figure 3B:
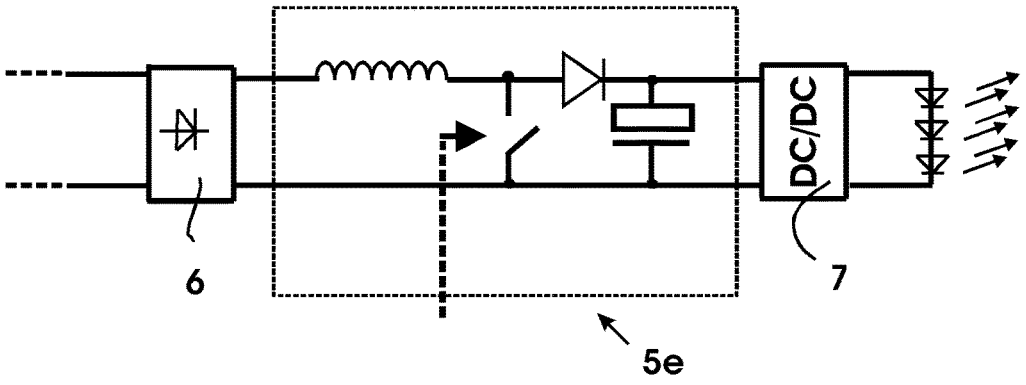
Figure 3C:
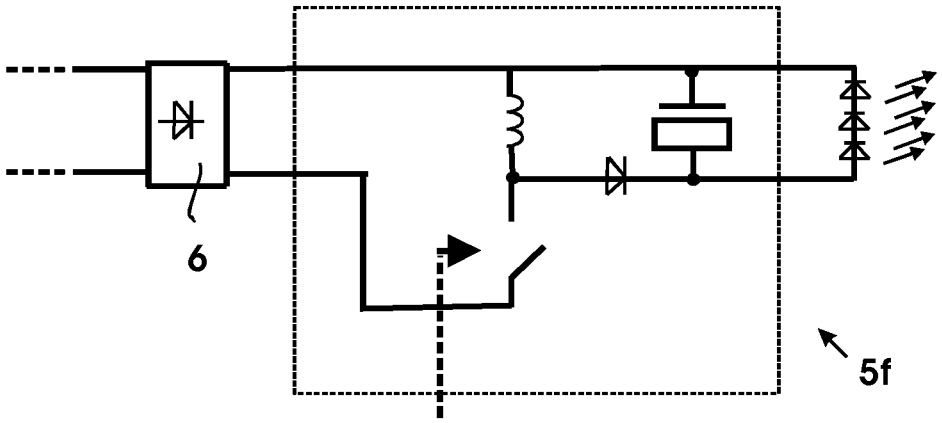

The current pulse injector 5 according to FIG. 2 may be realized by e.g. one or more current sources or by a control of a boost-PFC or buck-boost converter by changing the reference of the input current waveform. Various alternatives are shown in FIG. 3*a*-3*d*. For reasons of clarification, not all components of circuit arrangement 1 are shown in FIG. 3. In the setup of FIGS. 3*a* and 3*b*, an input with rectifier 6, an output 7 (DC/DC) and multiple LEDs are shown. The number of LEDs may depart from any of the shown embodiments.

FIG. 3*a* shows a total of four possible setups for the current pulse injector 5*a*-5*d*. Certainly, not all of the shown examples need to be present in one single circuit arrangement 1, but typically would be used alternatively.

As can be seen from FIG. 3*a*, the current pulse injector 5*a*-5*d* may comprise a controllable current source and/or a switchable, e.g. resistive/capacitive bleeder circuit to provide the additional current pulse. In FIG. 3*b* the current pulse injector 5*e* corresponds to the setup of a boost converter, while in FIG. 3*c* the current pulse injector 5*f* corresponds to a buck-boost or flyback converter, both are also referred to as power factor correction stage.

Figure 3D:
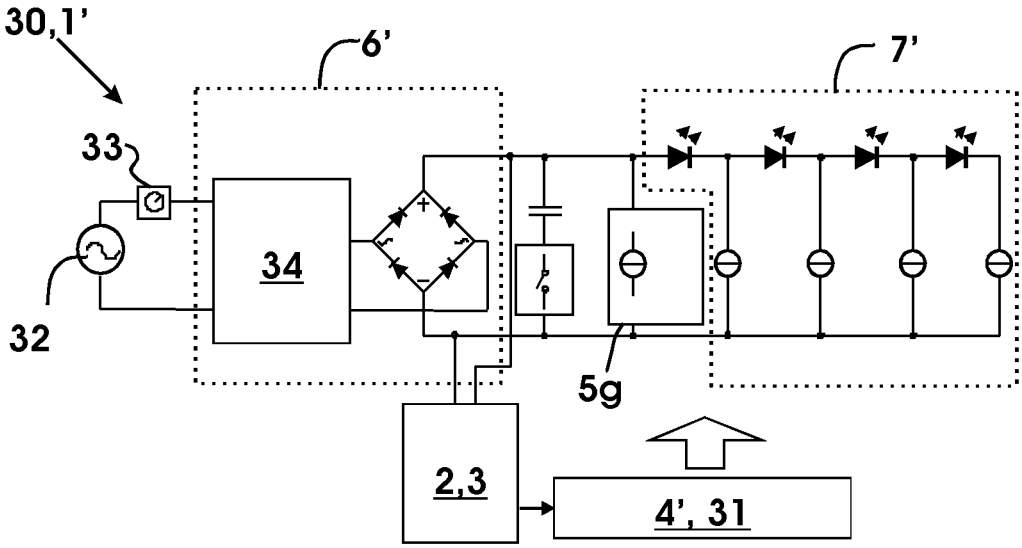

However, it is to be noted that the components of circuit arrangement 1 and in particular the current pulse injector 5 can be alternatively formed integrally with further components of circuit arrangement 1. A schematic setup of a LED lamp 30 with a circuit arrangement 1' according to a further embodiment of the present aspect of the invention is shown in FIG. 3*d*. Here, the input 6' comprises besides a bridge rectifier, an EMI filter and surge protection unit 34, connected to mains 32 over a leading-edge phase-cut dimmer/power supply 33.

The output 7' is formed with multiple LEDs in an arrangement with multiple current sources forming a tapped linear driver. Since the general setup of such a driver is known in the art, details of its operation are omitted. The pulse injector 5*g* according to the present example is a bleeder circuit comprising an adjustable current source normally configured to draw current from the dimmer if the voltage of the mains is too low to power the first LED in the string of LEDs. Said bleeder (or another current source) could according to the invention be configured and controlled in such a way that it provides said additional current pulse.

In the embodiment of FIG. 3*d*, a microcontroller 31 with a suitable programming forms the delay unit 4' and controls the current source of the bleeder 5*g* to draw said current pulse. The phase-cut timing detector 2 and a zero-crossing detector 3 are formed integrally. Microcontroller 31 also controls the further current sources of the tapped driver setup to provide a most compact setup.

Figure 3E:
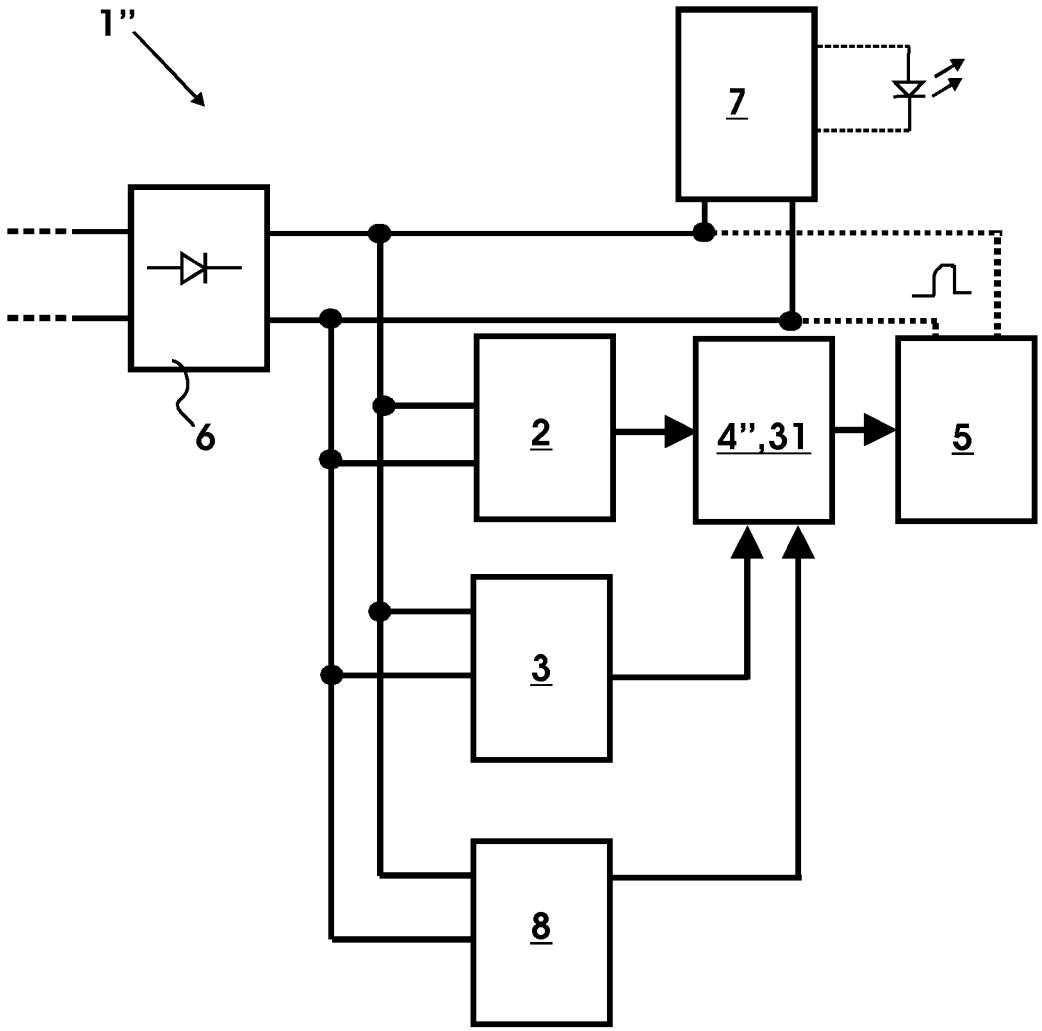

FIG. 3*e* shows a further embodiment of circuit arrangement 1". The embodiment corresponds to the embodiment of FIG. 2 with the exception of a further voltage detection circuit 8 and the delay unit 4", which here is in accordance with FIG. 3*d* formed by a microcontroller 31 with a suitable programming. The voltage detection circuit 8 determines the voltage at input 6 and provides a voltage signal to the microcontroller 31. The microcontroller 31 sets the delay and the pulse amplitude of the current pulse in an iterative procedure to determine the most suitable delay and amplitude and accordingly controls the pulse injector 5. Pulse injector 5 may show any of the setups shown in FIGS. 3*a*-3*d*.

Figure 3F:
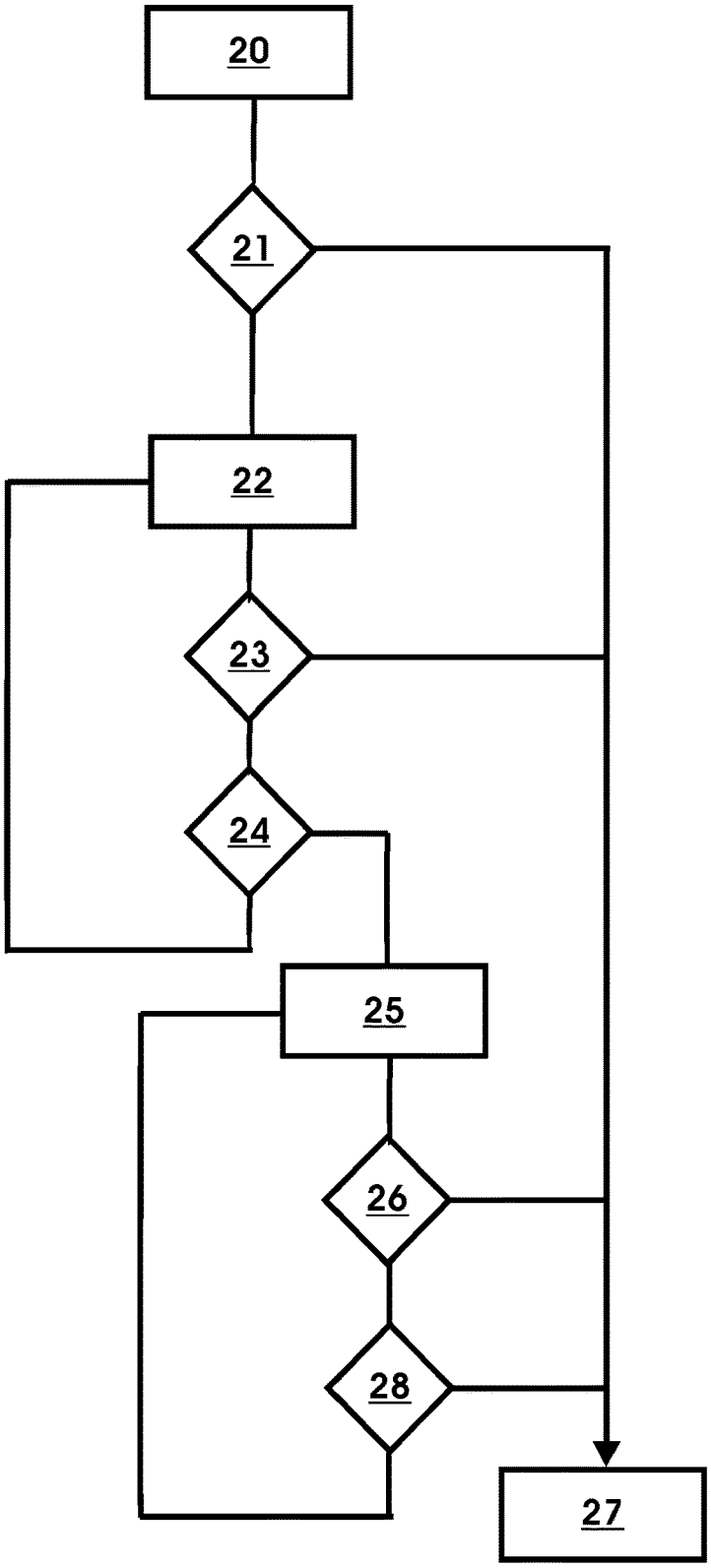
FIG. 3*f* shows a flow diagram of the operation of the embodiment according to FIG. 3*e*, FIG. 4*a*-4*b* show exemplary timing diagrams of the current waveform of a phase-cut power supply connected to multiple lamps.

The iterative procedure of microcontroller 31 is shown in FIG. 3*f*. The microcontroller 31 starts in step 20 and applies a standard delay time of 230 μs and a pulse amplitude of 200 mA. In step 21, the microcontroller 31 using the voltage detection circuit 8 determines, whether an "early disconnect", i.e. a disconnect of the TRIAC of the power supply occurs before the zero-crossing of the operating voltage by comparing the waveform at the input 6 to an internally stored expected waveform. In case no "early disconnect" is determined, the method ends at step 27 and the present parameters for delay and amplitude of the current pulse are used by the microcontroller 31 in further half-cycles of the operating voltage. In case however an "early disconnect" is determined, the microcontroller delays the current pulse in step 22 by 40 μs.

Subsequently in step 23, it is again determined whether an "early disconnect" occurs. If this is not the case, the method ends in step 27 with the present parameters. If the "early disconnect" still is determined, the microcontroller 31 in step 24 determines, whether the pulse can be further delayed, i.e. if the delayed pulse still would be in the range of 200 μs-700 μs. If the pulse can be further delayed, this is provided iteratively in step 22. If however no further delay is possible, the microcontroller 31 then varies the pulse amplitude in step 25 to determine, whether this prevents the "early disconnect" in step 26. In the present example, the pulse amplitude is incrementally increased by 5 mA. Again, if the "early disconnect" in step 26 cannot be determined, the method ends in step 27 with the present parameters. Otherwise, microcontroller 31 checks in step 28, whether a further increase of the pulse amplitude is possible. If this is the case, the amplitude is increased incrementally in step 25. Otherwise the method ends in step 27 without a pulse applied since the prevention of said "early disconnect" is not possible.

It should be apparent to one skilled in the art that many more implementations are possible. However, it is noted that that said additional boost current pulse does not necessarily require a boost converter. Any other converter or adaptable current source could be used for this purpose. However, according to a preferred embodiment said additional input current (from the boost peak) is converted and at least partially used to drive the LED lamp.

An example of parameters allowing stable operation at different phase angles is shown in the table below:

| Phase angle | Delay time | Pulse length | Pulse height | Power of pulse |
|---|---|---|---|---|
| 120 deg | 230 μs | 300 μs FWHM | 25 mA | 240 mW |
| 90 deg | 230 μs | 300 μs FWHM | 25 mA | 200 mW |
| 54 deg | 230 μs | 300 μs FWHM | 200 mA | 750 mW |

Figure 4A:
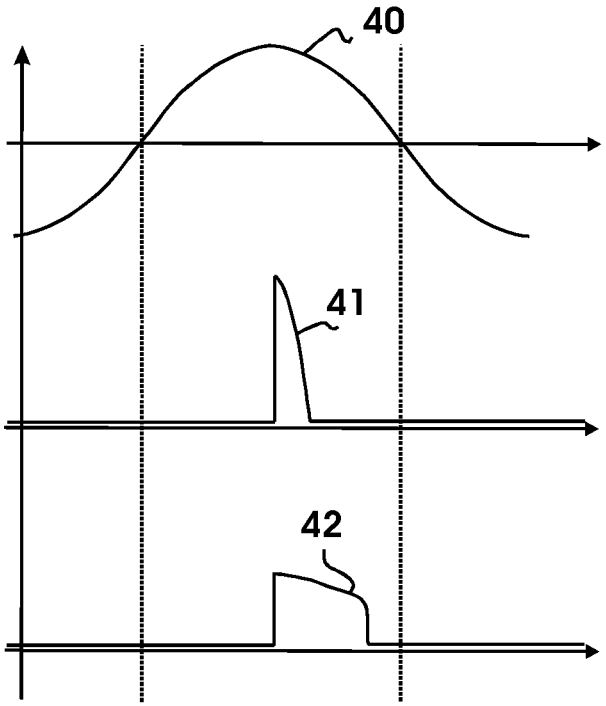
Figure 4B:
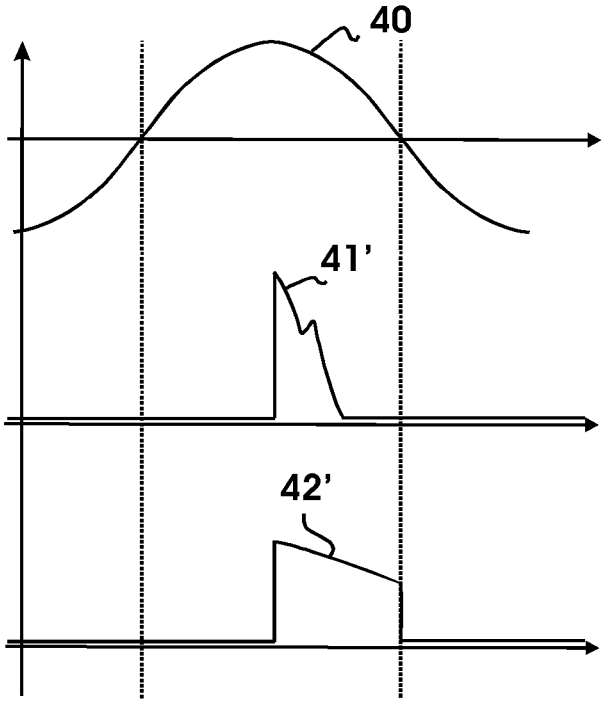

FIG. 4*a*-4*b* show exemplary timing diagrams of the current shape or waveform of a phase-cut power supply connected to multiple LED lamps.

While being connected in parallel behind a triac-based leading edge (LE) dimmer 33 LED lamps of different types (first and second type of LED lamp) produce light flicker. The phenomenon occurs when the lamps that employ the principle of energy intake during a narrow conduction time (first type of lamp) and the lamps that employ the principle of energy intake during the wide conduction time or an intended wide conduction interval (referred to as "improved power factor lamp" or "second type of lamp") are used together in a mixed-load configuration, as discussed in the preceding.

FIG. 4*a* shows at 40 an entire cycle of a sinusoidal operating voltage. Reference numeral 41 shows the dimmer/TRIAC current at 90 degrees phase angle. As can be seen, the TRIAC current 41 of phase-cut dimmer 33 rapidly drops to zero due to large dI/dt of the RPC of a first type of lamp, having a small conduction interval. The lamp voltage 42 clearly shows early or "unintended disconnect", since the voltage collapses prior to the zero-crossing of the mains voltage.

FIG. 4*b* illustrates a first example demonstrating the working principle of the invention. The TRIAC current 41' shows the additional boost current pulse according to the invention at a delay time of about 230 μs after the rising edge of the LE dimmer. Said additional boost current will temporally change the negative dI/dt in the dimmer caused by the other lamp of said first type into a positive or at least significant less negative dI/dt in the most critical phase, which is the tail of the RPC of the other lamps. Thereby the present aspect of the invention prevents inducing the oscillation or damp the oscillation preventing the dimmer from unintentional disconnect, which can be seen from lamp voltage 42'. Here, the voltage is present until the subsequent zero-crossing of mains voltage 40.

A second aspect of the present invention concerns a detection circuit to determine, whether a first type of lamp having a narrow conduction interval is connected to a phase-cut power supply or dimmer. Said detection circuit is particularly advantageous when combined with the circuit arrangement of FIG. 2 and/or in a improved power factor lamp, i.e. in an according LED driver circuit.

Figure 5:
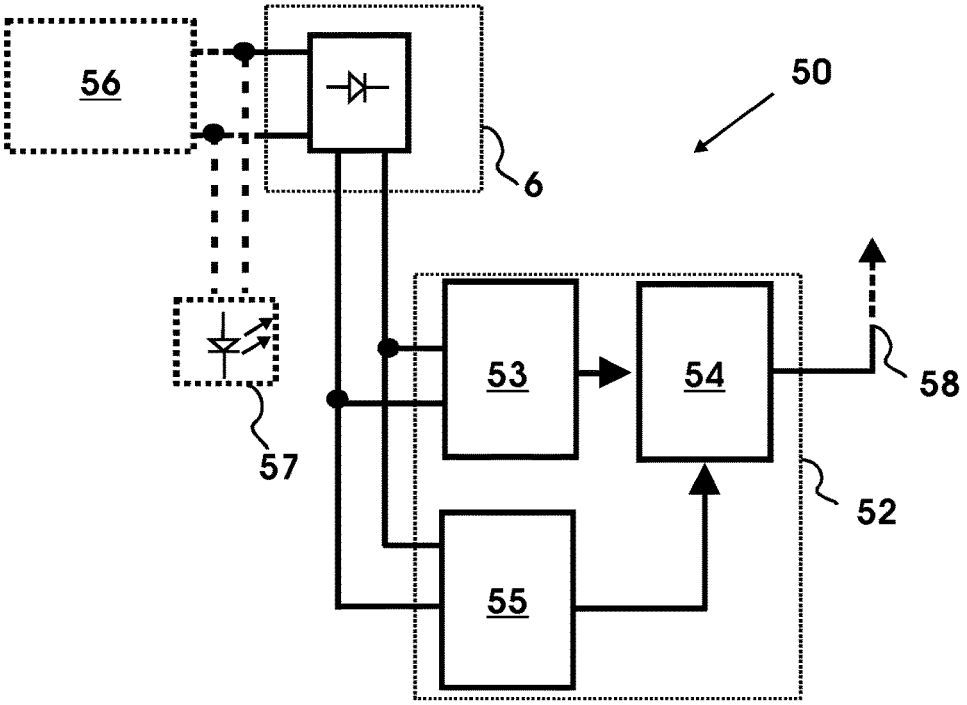
FIG. 5 shows an embodiment of a detection circuit according to a second aspect of the invention in a schematic block diagram.

An embodiment of a detection circuit 50 in a schematic block diagram is shown in FIG. 5. The detection circuit 50 comprises an input 6 having a bridge type rectifier for connection with a power supply 56 to receive a phase-cut operating voltage. The power supply 56 according to the present example comprises a phase-cut dimmer of leading edge type (LE dimmer, not shown). The input 6 may certainly comprise further components and in particular a secondary capacitor as EMI filter may be comprised in input 6.

The detection circuit 50 furthermore comprises a lamp compatibility detector 52, which is configured to determine, whether a further lamp 57 is connected to the same power supply 56. In particular, the detection circuit 50 determines, whether a parallel lamp 57 of the before mentioned first type, having a narrow conduction interval, is present. The detector 52 comprises a zero-crossing detector 55 and an edge detector 53. Processor 54 comprises a suitable programming to determine, whether an edge of said LE dimmer is present between each of the zero-crossings for the duration of an 5 half-cycles of the operating voltage. In case of a parallel lamp 57 of first type, an edge will be present between each of the zero-crossings of the voltage. The processor 54 accordingly provides a compatibility signal to allow to set an LED driver circuit from a normal operating mode to a compatibility mode when said parallel lamp 57 is present.

Figure 6:
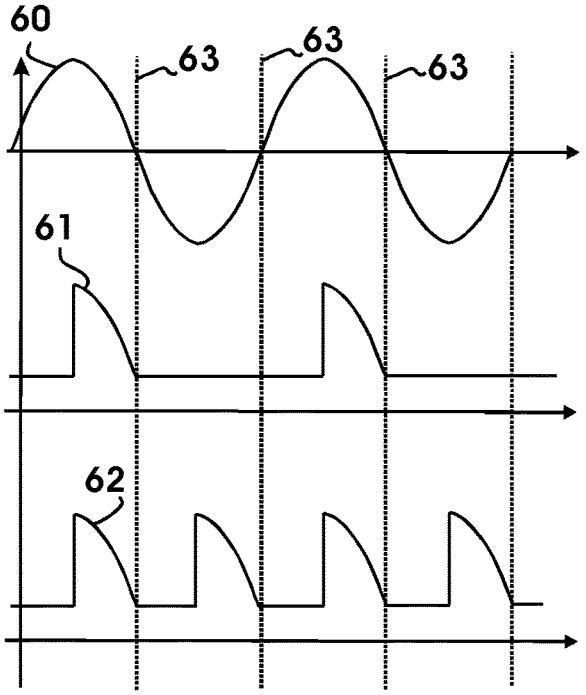
FIG. 6 shows waveforms that illustrate operation of the embodiment of FIG. 5.

The details of the operation of the detection circuit 50 are shown in FIG. 6. The upper part of FIG. 6 shows a typical sine waveform, e.g. a mains operating voltage 60, as typically provided to power supply dimmer 56. The dotted lines 63 depict the zero-crossings of voltage 60. A phase-cut operating voltage 61 is shown in the middle part of FIG. 6. Here, the phase-cut operation of power supply dimmer 56 can be seen, which without load is present every two half-cycles, but can also occur at every 3, 4, 5 etc. cycles or on an irregular basis, i.e. not every consecutive cycle. The lower part of FIG. 6 shows at 62 the resulting voltage waveform in case of a parallel connection of lamp 57 of said first type. Here, a phase-cut operation is present in each half-cycle and thus between each zero-crossing. This is used by processor 54 to determine the presence of said lamp 57.

Once the presence or absence of the parallel lamp 57 is determined within said initialization period, a corresponding compatibility signal is provided by processor 54 over connection 58, e.g. to a LED driver circuit. The processor 54 stores the result in an internal storage unit (not shown) to continuously provide the compatibility signal, but then stops further detection.

Accordingly, after the detector 52 is powered-up, it will "listen" to the voltage at the input 6 for several mains cycles and "learn" in this way whether any lamps of first type 57 are present. When being powered-up the lamps 57 would start immediately and the phase-cut signal with the steep edges that is produced by the dimmer would appear at the input 51 of the proposed detection circuit 50 at every half-cycle.

Figure 7:
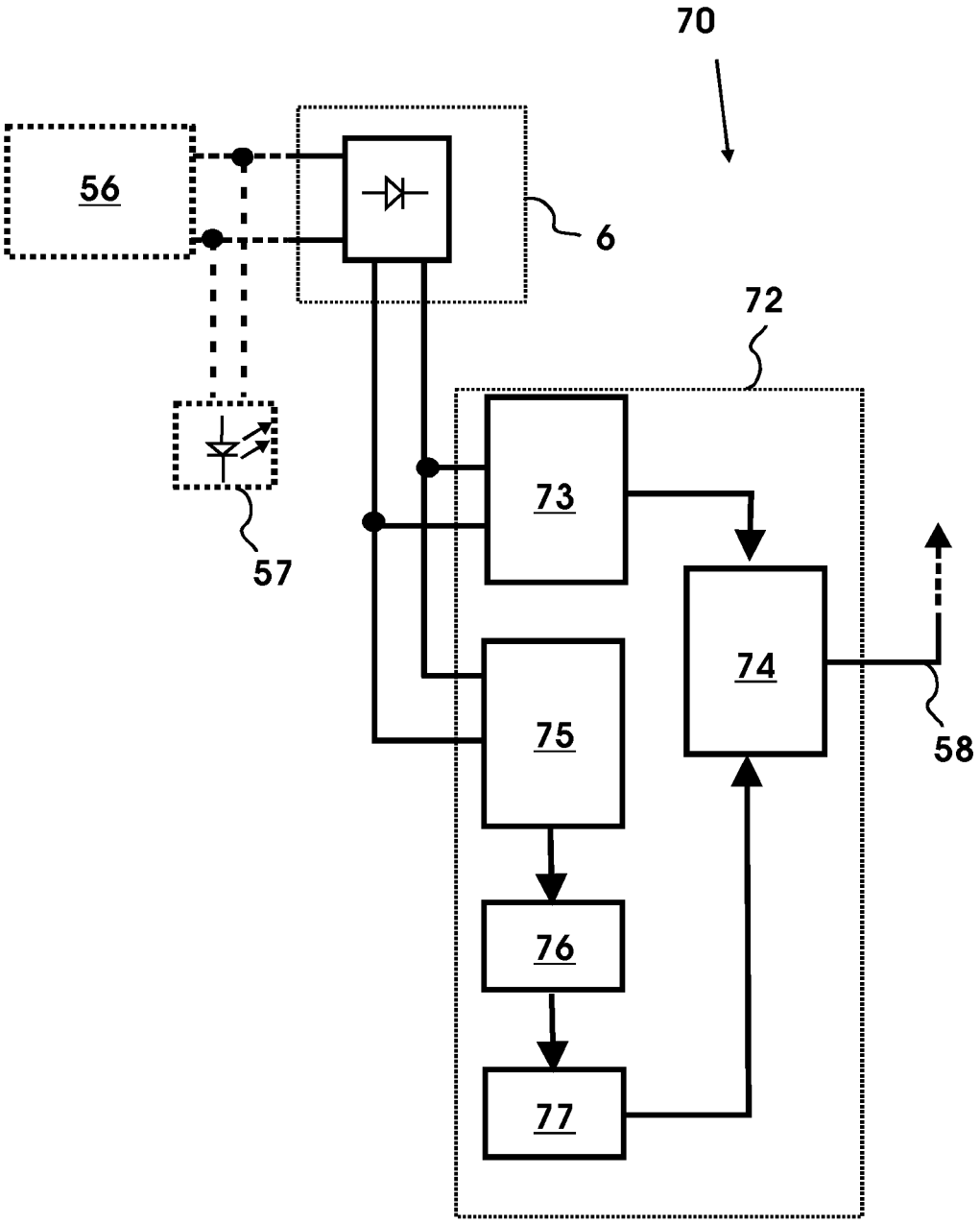
FIG. 7 shows a second embodiment of a detection circuit in a schematic block diagram.

FIG. 7 shows a further embodiment of the detection circuit 70, which corresponds to the setup of detection circuit 50, shown in FIG. 5, which the exception of detector 72. The detector 72 in this embodiment comprises a voltage detection circuit 73, connected with comparator 74. The voltage detection circuit 73 measures the momentary operating voltage and provides the derivative of the voltage to comparator 74. Zero-crossing detector 75 detects the position of the zero-crossings and starts a counter 76 at the zero-crossing. The counter 76 provides indexing to a processor 77, which processor 77 comprises a stored look-up table, comprising values of the voltage gradient dV/dt of an ideal sinusoidal voltage for a given instant in time. Processor 77 correspondingly provides values of a predefined gradient waveform, i.e. a reference derivate, to the comparator 74.

Comparator 74 compares the derivative of ideal momentary sine wave with the derivate of the measurement result. If the measured gradient dV/dt does not substantially correspond to the calculated reference derivative, i.e. is not within a range of +/−10V of the expected value, a parallel lamp 57 is present and comparator 74 provides the corresponding compatibility signal over connection 58 to an e.g. connected LED driver circuit.

Figure 8:
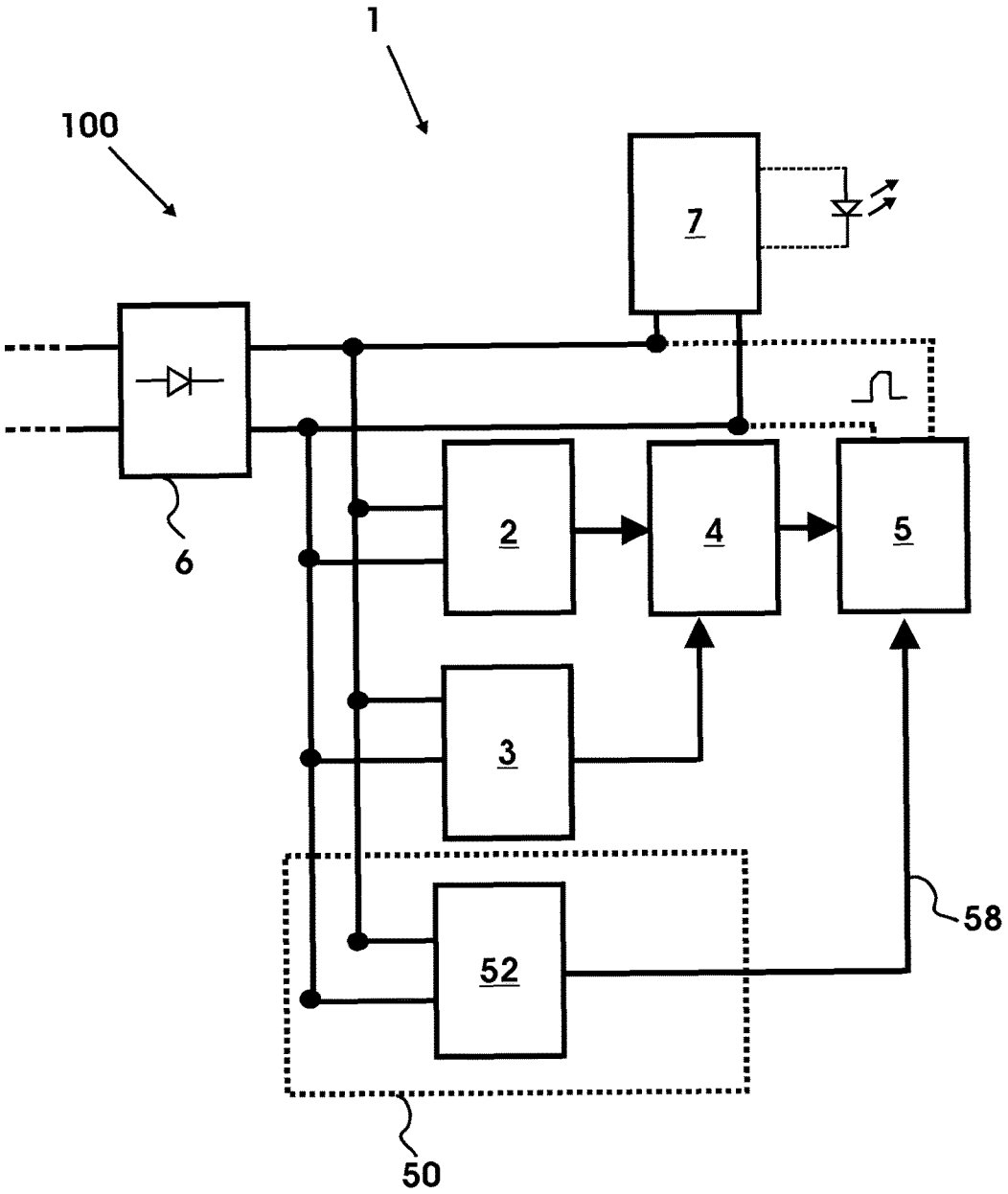
FIG. 8 shows a an embodiment of a LED driver circuit comprising a combination of the circuit arrangement of FIG. 2 together with the detection circuit of FIG. 5

FIG. 8 shows a combination of the circuit arrangement of FIG. 2 together with the detection circuit of FIG. 5, i.e. a LED driver 100 combining both of the before mentioned aspects of the invention. The setup and operation of LED driver circuit 100 corresponds to the above description of FIG. 2, with the exception that a further detection circuit 50 with a lamp compatibility detector 52 according to FIG. 5 is present. Here, detector 52 is connected with the pulse injector 5, so that the current pulse is only generated, when the detector 52 indicates the parallel connection of a lamp 57 of said first type (not shown in FIG. 8), advantageously increasing the efficiency of the driver 100.

Figure 9:
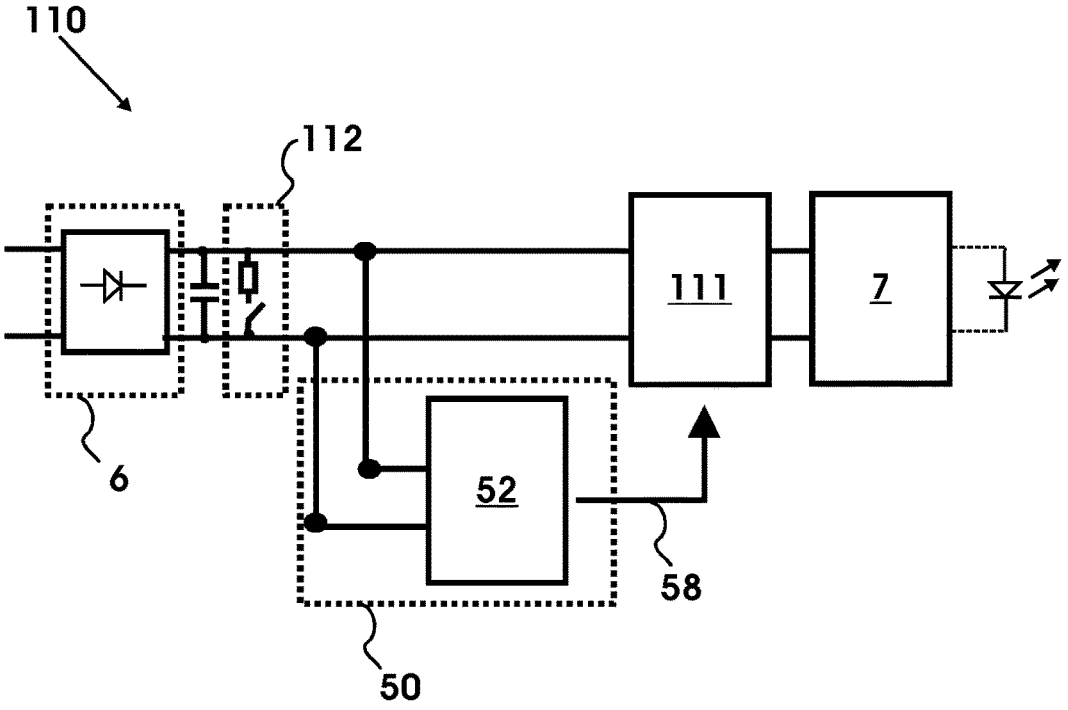
FIG. 9 shows an embodiment of a further LED driver circuit with a detection circuit according to FIG. 5 in a schematic block diagram.

FIG. 9 shows a further example of an LED driver circuit 110. The driver circuit comprises an input 6 for connection to a phase-cut power supply and an output 7 for connection to one or more LEDs. Furthermore, the driver circuit 110 comprises a controllable power converter 111 to provide the LEDs with a suitable operating current. Power converter 111 is adapted to operate in a normal operating mode and a compatibility mode. In the compatibility mode, the conduction interval, i.e. the time, in which the power converter 111 draws a current from the connected power supply, is shorter than in the normal operating mode. In the normal operating mode, the power converter 111 is configured to draw a current above the hold current of the power supply/dimmer (not shown) for the entire ON-time of the power supply, i.e. with respect to a LE dimmer, the time between phase-cut edge initiated by the dimmer and next zero-crossing of the alternating phase-cut operating voltage. In the compatibility mode, the power converter 111 draws a current for a maximum of 50% of the ON-time of the power supply.

Although the efficiency in the compatibility mode may be reduced, the shortened conduction interval provides compatibility to a parallel connected lamp of first type, i.e. also having a short conduction interval. The power converter 111 thus "mimics" the input current behavior of the lamp of first type. To switch between two modes, the LED driver circuit 110 comprises a detection circuit 50 according to FIG. 5. The before mentioned detection circuit 50 provides the power converter 111 with the compatibility signal, indicating the presence of said parallel lamp, so that the compatibility mode is only entered when said parallel lamp is detected.

The power converter 111 in this embodiment is a switch mode power supply, allowing to set the conduction interval. The power converter 111 in the embodiment is a switch mode boost converter, although a buck-boost may also be used.

The LED driver circuit 110 further comprises a bleeder circuit 112, placed across an EMI filter capacitor of the driver circuit 110. While being charged at startup this EMI filter capacitor will block the diode bridge of the input 6 from conducting and sensing the voltage across terminals of the input 6. Therefore, the capacitor must be slightly discharged by means of the weak/resistive bleeder circuit 112. The speed of this discharge on one hand must be such that the dimmer is not re-fired during the next mains half-cycle and on other hand firing of the dimmer must be detectable over the entire mains half-cycle at the both high and low dimming angles. Alternatively or additionally to bleeder circuit 112, a controllable current source might be used for the discharge process.

The invention has been illustrated and described in detail in the drawings and foregoing description. Such illustration and description are to be considered illustrative or exemplary and not restrictive; the invention is not limited to the disclosed embodiments. For example, it may be possible to operate the invention in an embodiment, in which:

in the embodiments of FIGS. 8 and 9, instead of the detector 52 of FIG. 5, the detector 72 according to FIG. 7 is used and/or the circuit arrangement of FIGS. 2-3, the detection circuit of FIGS. 5 and 7 and/or the LED driver circuit of FIGS. 8-9 are integrated in an LED lamp.

In the claims, the word "comprising" does not exclude other elements, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A circuit arrangement for operating at least one lighting unit with a phase-cut power supply, comprising:

an input for receiving a phase-cut operating voltage from said power supply, wherein the phase-cut operating voltage comprises at least one phase-cut edge; and a pulse injection circuit, configured to determine a phase-cut operation of said power supply by detection of the phase-cut edge of said operating voltage and to draw a current pulse from said power supply after a delay time between 200-700 μs after said phase-cut edge, the pulse injection circuit comprising:

a phase-cut timing detector connected with said input and configured to detect the phase-cut edge of said operating voltage, a controllable delay unit connected with said phase-cut timing detector and configured to provide a trigger signal within the delay time of 200-700 μs after said phase-cut edge; and a current pulse injector, connected with said controllable delay unit and said input and configured to draw said current pulse from said phase-cut power supply upon reception of said trigger signal, wherein the controllable delay unit is further configured to iteratively adjust the delay time until an early disconnect is prevented, wherein the early disconnect occurs when the phase-cut power supply disconnects before a zero-crossing of the operating voltage.

2. The circuit arrangement of claim 1, wherein said delay time is between 200-500 μs.

3. The circuit arrangement of claim 1, wherein said controllable delay unit is additionally configured to set the delay time according to an ON-time between the phase-cut edge and a subsequent zero-crossing of the phase-cut operating voltage.

4. The circuit arrangement of claim 3, wherein the controllable delay unit is configured to increase the delay time when said ON-time increases.

5. The circuit arrangement of claim 4, wherein the controllable delay unit is configured to increase the delay time when said ON-time increases, so that the delay time is between 200-400 μs for an ON-time of 2 ms and between 500-600 μs for an ON-time of 5 ms.

6. The circuit arrangement of claim 5, wherein said controllable delay unit is adapted to only provide said trigger signal when said ON-time is between 1 ms-5 ms.

7. The circuit arrangement of claim 3, further comprising a zero-crossing detector, connected with said pulse injection circuit to provide zero-crossing timing information of said phase-cut operating voltage to determine said ON-time between the phase-cut operation of said power supply and a subsequent zero-crossing of the phase-cut operating voltage.

8. The circuit arrangement of claim 3, further comprising a voltage detection circuit, coupled with said pulse injection circuit to provide a voltage signal, indicative of the voltage at said input, said pulse injection circuit being configured to set the delay time and/or the amplitude of said current pulse in dependence of said voltage signal.

9. The circuit arrangement of claim 1, wherein the pulse injector comprises a buffering device to store the current drawn by the pulse and to provide the current to the at least one lighting unit.

10. The circuit arrangement of claim 1, further comprising a detection circuit with a lamp compatibility detector, said lamp compatibility detector being connected with said pulse injection circuit to provide a compatibility signal, wherein said detector is configured to determine the presence of a parallel lamp, connected in parallel with said circuit arrangement to said phase-cut power supply, so that said current pulse is only generated when said compatibility signal indicates said parallel lamp.

11. The circuit arrangement of claim 1, wherein the circuit arrangement is an LED driver circuit, comprising said input and said output, wherein said at least one lighting unit is an LED unit.

12. An LED lamp comprising a circuit arrangement according to claim 11, and at least one LED unit, connected to the output of said circuit arrangement.

13. A lighting system comprising a power supply adapted to provide a phase-cut operating voltage and one or more LED lamps according to claim 12, connected to said power supply.

14. The circuit arrangement of claim 1, wherein the current pulse injector comprises a tapped linear driver, configured to draw the current pulse from the phase-cut power supply.

15. The circuit arrangement of claim 1, wherein the iterative adjustment of the delay time is by a constant increment.

16. The circuit arrangement of claim 15, wherein the constant increment is one tenth of the delay time.

17. A method of operating at least one lighting unit with a circuit arrangement, the method comprising the steps of:

receiving a phase-cut operating voltage from a phase-cut power supply at an input of the circuit arrangement, wherein the phase-cut operating voltage comprises at least one phase-cut edge;

determining the phase-cut operation of said power supply by detection of the phase-cut edge of said operating voltage;

providing, by a controllable delay unit, a trigger signal to a current pulse injector of the circuit arrangement within a delay time of 200-700 μs after the phase-cut edge;

drawing a current pulse from said power supply upon reception of the trigger signal; and iteratively adjusting the delay time until an early disconnect is prevented, wherein the early disconnect occurs when the phase-cut power supply disconnects before a zero-crossing of the operating voltage.

18. A non-transitory computer readable medium comprising a computer readable program for operating at least one lighting unit with a circuit arrangement, wherein the computer readable program when executed on a computer cause the computer to perform the steps of:

receiving a phase-cut operating voltage from a phase-cut power supply at an input of the circuit arrangement, wherein the phase-cut operating voltage comprises at least one phase-cut edge;

determining the phase-cut operation of said power supply by detection of the phase-cut edge of said operating voltage;

providing, by a controllable delay unit, a trigger signal to a current pulse injector of the circuit arrangement after a delay time of 200-700 μs after the phase-cut edge; and drawing a current pulse from said power supply upon reception of the trigger signal; and iteratively adjusting the delay time until an early disconnect is prevented, wherein the early disconnect occurs when the phase-cut power supply disconnects before a zero-crossing of the operating voltage.

* * * * *